US006877424B1

(12) United States Patent
Wallace et al.

(10) Patent No.: US 6,877,424 B1
(45) Date of Patent: Apr. 12, 2005

(54) COUNTERPOISE DEVICE AND METHOD FOR CANTILEVERED PRINTING PRESS CYLINDERS

(75) Inventors: Eric Matthew Wallace, Manchester, NH (US); Lev Zlatin, Portsmouth, NH (US)

(73) Assignee: Goss International Americas, Inc., Dover, NH (US)

( * ) Notice: Subject to any disclaimer, the term of this patent is extended or adjusted under 35 U.S.C. 154(b) by 0 days.

(21) Appl. No.: 10/798,092

(22) Filed: Mar. 11, 2004

(51) Int. Cl.[7] ..... B41F 5/00; B41F 7/02; B41F 17/00

(52) U.S. Cl. ..... 101/216; 101/479

(58) Field of Search ..... 101/216, 217–218, 101/152, 153, 247, 375, 376, 479

(56) References Cited

U.S. PATENT DOCUMENTS 4,458,591 A * 7/1984 Guaraldi ..... 101/247
4,875,936 A * 10/1989 Hermach ..... 101/218
5,105,498 A 4/1992 Dinkelacker ..... 15/104
5,237,920 A 8/1993 Guaraldi ..... 101/216
5,429,048 A 7/1995 Gaffney et al. ..... 101/217
5,678,485 A * 10/1997 Guaraldi ..... 101/247
5,706,728 A * 1/1998 Motard et al. ..... 101/247
6,343,547 B1 * 2/2002 Callahan et al. ..... 101/216
6,435,086 B1 * 8/2002 Rendleman et al. ..... 101/177

* cited by examiner

*Primary Examiner*—Eugene H. Eickholt
(74) *Attorney, Agent, or Firm*—Davidson, Davidson & Kappel, LLC

(57) ABSTRACT

A counterpoise device for cantilevering at least one cylinder of a printing press has a movable counterpoise element for selectively contacting the cylinder and a stationary mount. A guide link rotatably attaches to the stationary mount plate and rotatably attaches to movable counterpoise element. An actuating device is connected to the movable counterpoise device at a different location than the guide link for moving the counterpoise device with respect to the cylinder.

15 Claims, 3 Drawing Sheets

COUNTERPOISE DEVICE AND METHOD FOR CANTILEVERED PRINTING PRESS CYLINDERS

BACKGROUND INFORMATION

The present invention relates generally to web printing presses and more particularly to a method and device for counterpoising a printing press cylinder.

In certain printing presses, a printing press cylinder may be cantilevered when the press is stopped to permit a printing sleeve, such as a tubular printing blanket, to be slid axially over the cantilevered cylinder. U.S. Pat. No. 5,429,048 to Gaffney et al. discloses an offset lithographic printing press with such a blanket, and is hereby incorporated by reference herein.

U.S. Pat. Nos. 6,343,547 and 5,105,498, hereby incorporated by reference herein, disclose counterpoise devices for providing support while the printing press cylinder is cantilevered. During a printing operation, the cylinder is no longer cantilevered, e.g. the cylinder is supported at the other end by a movable bearing, and the counterpoise mechanism is out of contact with the cylinder.

BRIEF SUMMARY OF THE INVENTION

An object of the present invention is to provide for easier adjustment of the counterpoise device. An alternate or additional object of the present invention is to simplify the counterpoise device. Another alternate or additional object of the present invention is to permit proper motion of the counterpoise device.

The present invention provides a counterpoise device for cantilevering at least one cylinder of a printing press, the device including a movable counterpoise element for selectively contacting the cylinder, a stationary mount, a guide link rotatably attached to the stationary mount plate and rotatably attached to the movable counterpoise element; and an actuating device connected to the movable counterpoise device at a different location than the guide link for moving the counterpoise device with respect to the cylinder.

The counterpoise device of the present invention permits for simple guiding of the motion through both the actuating device and the guide link. The dual pivot points on the guide link permit for easier adjustments and vertical and horizontal movement of the counterpoise element.

Preferably, the counterpoise element is a lift plate with a hole for receiving an end of the cylinder. The lift plate may have a further hole for an eccentric of the actuating device.

Preferably, a second movable counterpoise element is provided with a second guide link rotatably attached to the mount plate. The actuating device then may actuate both counterpoise elements at the same time.

The guide link may be attached to the counterpoise element via an adjustment plate fixable to the counterpoise element, for example via bolts fixedly attachable to the counterpoise element. The adjustment plate may have slots for receiving the bolts.

The guide link may be attached rotatably to the mount plate and the counterpoise element via shoulder bolts or bearings.

The actuating device may move the counterpoise elements in a first direction, and the pivot points of the guide link may form an imaginary line which is not parallel to the first direction, and is preferably perpendicular to the first direction.

The present invention also provides a printing unit having the counterpoise device, a printing press having the printing unit. The printing press preferably is a web offset printing press with two blanket cylinders being side-by-side, i.e. with the web traveling vertically between the two blanket cylinders. However, the web may also travel horizontally.

The present invention also provide a method for counterpoising a cylinder comprising: moving a counterpoise element using an actuating device, and constraining the movement of the counterpoise element using a dual pivot guide link.

BRIEF DESCRIPTION OF THE DRAWINGS

The present invention will be further described with respect the following Figures, in which.

DETAILED DESCRIPTION

Figure 1:
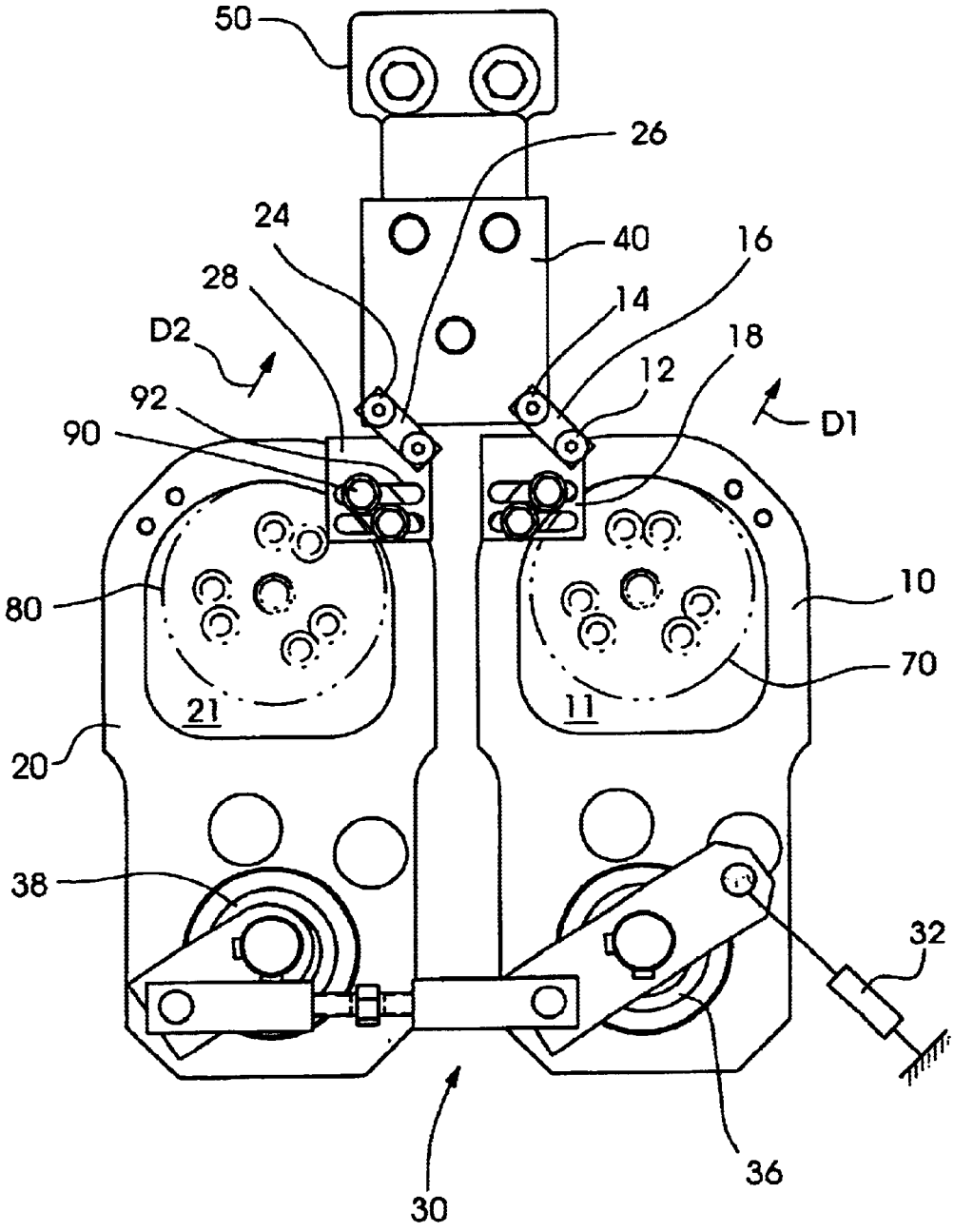
FIG. 1 shows schematically a side view an embodiment of the counterpoise device of the present invention.

FIG. 1 shows a first counterpoise element 10 and a second counterpoise element 20, here designed as lift plates with holes 11, 21, respectively, for selectively counterpoising ends of blanket cylinders 70, 80, respectively. FIG. 1 shows the counterpoise device cantilevering the blanket in cylinders 70, 80. The counterpoising elements 10, 20 can move in directions D1, D2 so that during printing of the printing press elements 10, 20 no longer contact cylinders 70, 80, respectively. An actuating device 30, for example with two eccentrics 36, 38 located in holes in the counterpoise elements 10, 20, respectively, and having an actuator 32 shown schematically, can provide selective movement of the counterpoising elements 10, 20.

Adjustment plates 18, 28 can be fixedly attached to the counterpoising elements 10, 20 via bolts 90, which fit in slots 92 of the adjustment plates. The bolts 90 may be loosened to permit adjustment of plates 18, 28 with respect to the counterpoising elements 10, 20, but are fixed again prior to counterpoising.

Pivotally attached to the adjustment plates 18, 28 are guide links 16, 26, respectively, which are also pivotally connected to a stationary mount plate 40. Bolts or bearings 12, 14 and 22, 24, respectively, are used to provide the two pivots for each guide link 16, 26. The slots 92 of the adjustment plate 28 may be parallel to an imaginary line formed between the axes of the blanket cylinders 70, 80, and an imaginary line between two of the bolts 92 of one plate 28 arranged parallel to the imaginary line formed by the pivot points of one of the guide links 16, 26.

A mounting block 50 may be provided for the mount plate 40.

The guide link 16 thus has two pivot points formed by bolts 12, 14, and an imaginary line between these points may be approximately perpendicular to the direction of motion D1.

Figure 2:
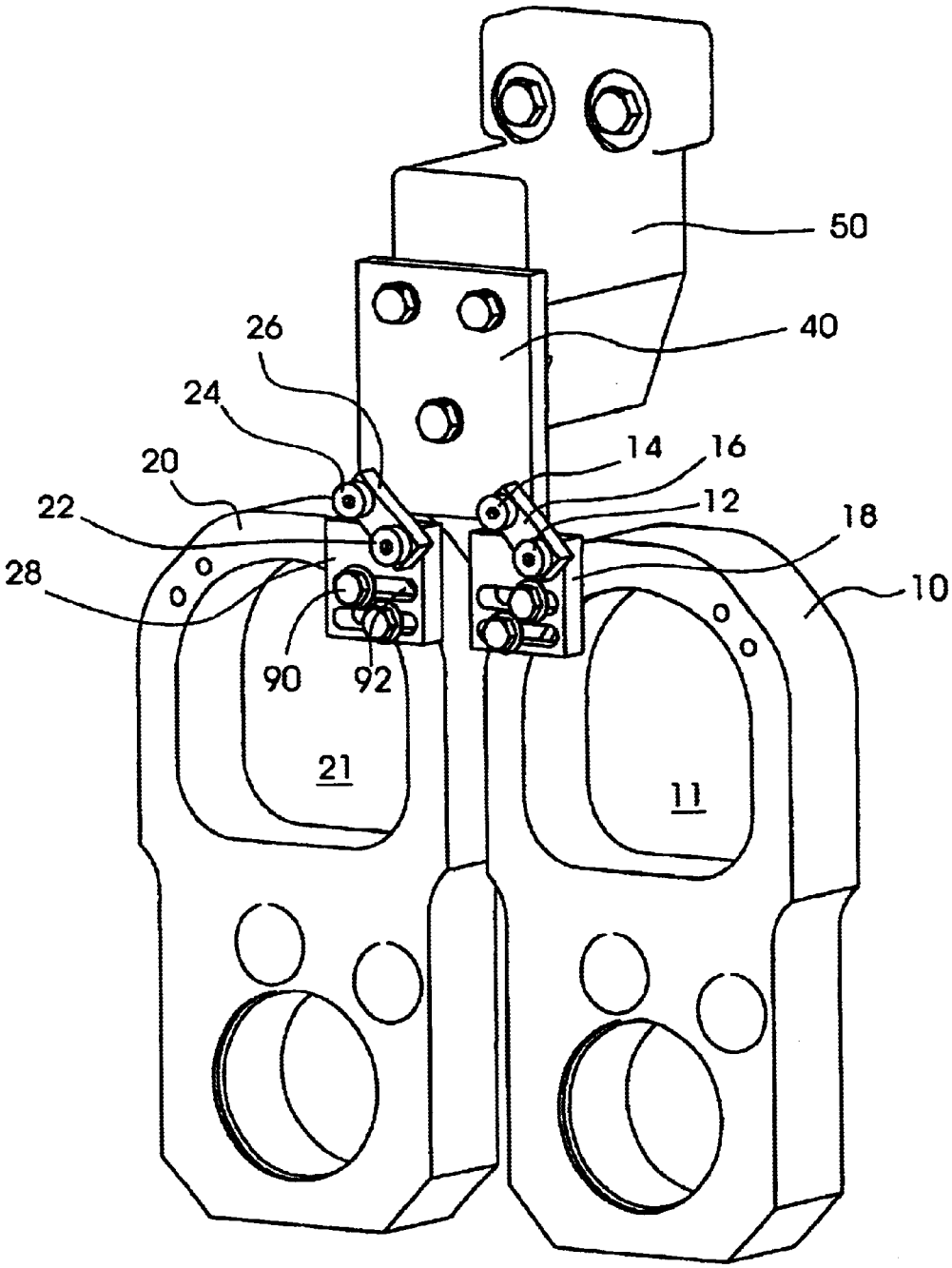
FIG. 2 shows a perspective view of the FIG. 1 view without the actuating device.
Figure 3:
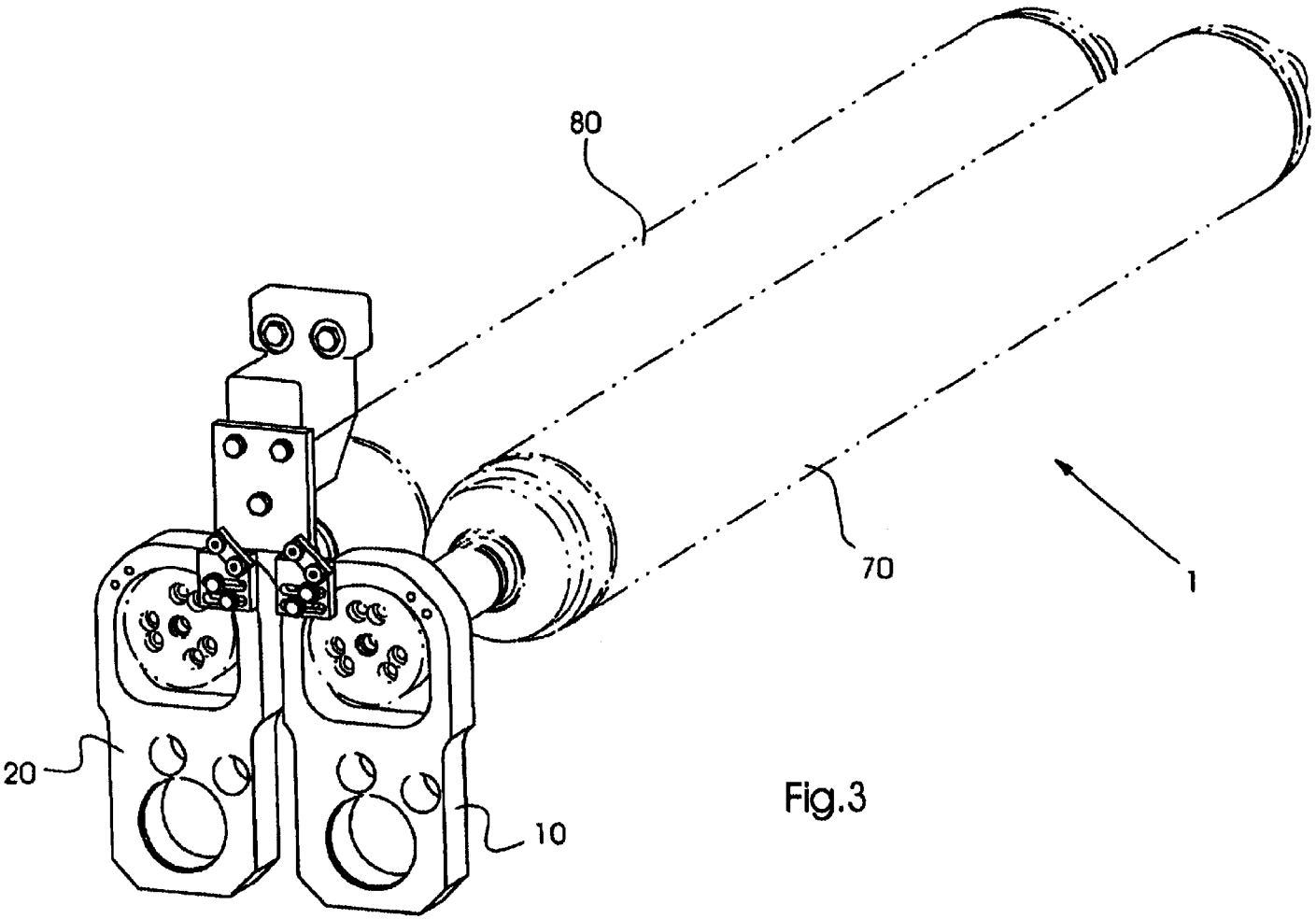
FIG. 3 shows the counterpoise device with two blanket cylinders of an offset web printing press.

FIG. 2 shows a perspective view of the FIG. 1 embodiment, and FIG. 3 shows the two blanket cylinders 70, 80 of a web offset printing press having a vertically traveling web, i.e. the blanket cylinders of a print unit are spaced horizontally and the web travels therebetween. The present invention however may also be used with blanket cylinders placed vertically one over the other, and may be used with the print units and printing presses described in incorporated-by-reference U.S. Pat. Nos. 6,343,547 and 5,105,498. While the printing cylinder in the shown embodiment has been described as a blanket cylinder, it could also be another cylinder such as a plate cylinder.

LIST OF DRAWING NUMBERS

1 printing press
10 counterpoise element
11 hole
12 bolt
14 bolt
16 guide link
18 adjustment plate
20 counterpoise element
21 hole
22 bolt
24 bolt
26 guide link
28 adjustment plate
30 actuating device
32 actuator
36 eccentric
38 eccentric
40 mount plate
50 mounting block
70 blanket cylinder
80 blanket cylinder
90 bolts
92 slots

What is claimed is:

1. A counterpoise device for cantilevering at least one cylinder of a printing press, the device comprising:

a movable counterpoise element for selectively contacting the cylinder;

a stationary mount plate;

a guide link rotatably attached to the stationary mount plate and rotatably attached to the movable counterpoise element; and an actuating device connected to the movable counterpoise device at a different location than the guide link for moving the counterpoise device with respect to the cylinder.

2. The device as recited in claim 1 wherein the counterpoise element is a lift plate with a hole for receiving an end of the cylinder.

3. The device as recited in claim 2 wherein the lift plate has a further hole and the actuating device has an eccentric fitting in the further hole.

4. The device as recited in claim 1 further comprising a second movable counterpoise element attached to the actuating device, and a second guide link rotatably attached to the mount and the second movable counterpoise element.

5. The device as recited in claim 1 further comprising an adjustment plate, the guide link being attached to the counterpoise element via the adjustment plate, the adjustment plate being fixable to the counterpoise element.

6. The device as recited in claim 5 wherein the adjustment plate has slots.

7. The device as recited in claim 1 further comprising bolts or bearings, the guide link being attached rotatably to the mount plate and the counterpoise element via the bolts or bearings.

8. The device as recited in claim 1 wherein the actuating device moves the counterpoise element in a first direction, and pivot points of the guide link form an imaginary line, the imaginary line not being parallel to the first direction.

9. The device as recited in claim 8 wherein the imaginary line is perpendicular to the first direction.

10. A printing unit comprising the counterpoise device of claim 1.

11. A printing press comprising the counterpoise device of claim 1 and the cylinder.

12. The printing press as recited in claim 11 wherein the cylinder is a blanket cylinder and further comprising a second blanket cylinder.

13. The printing press as recited in claim 12 wherein the printing press is a web offset printing press.

14. The printing press as recited in claim 11 wherein the blanket cylinder and second blanket cylinder are located horizontally next to each other.

15. A method for counterpoising a cylinder comprising:

moving a counterpoise element using an actuating device, and constraining the movement of the counterpoise element using a dual pivot guide link.

* * * * *